US007464488B2

(12) United States Patent
Jones et al.

(10) Patent No.: US 7,464,488 B2
(45) Date of Patent: Dec. 16, 2008

(54) REVERSIBLE FOOTWEAR STRAP

(75) Inventors: Lindell B. Jones, Chesterfield, MO (US); Raymond F. Tonkel, Sudbury, MA (US)

(73) Assignee: U Turn Sports, Co LLC., St. Louis, MO (US)

( * ) Notice: Subject to any disclaimer, the term of this patent is extended or adjusted under 35 U.S.C. 154(b) by 580 days.

(21) Appl. No.: 10/942,371

(22) Filed: Sep. 16, 2004

(65) Prior Publication Data

US 2005/0039345 A1 Feb. 24, 2005

Related U.S. Application Data

(63) Continuation-in-part of application No. 10/771,196, filed on Feb. 3, 2004, now Pat. No. 6,904,706, and a continuation-in-part of application No. 10/437,140, filed on May 13, 2003, now abandoned, and a continuation-in-part of application No. 10/222,313, filed on Aug. 15, 2002, now abandoned, and a continuation-in-part of application No. 10/122,995, filed on Apr. 11, 2002, now Pat. No. 6,574,887.

(60) Provisional application No. 60/285,693, filed on Apr. 24, 2001.

(51) Int. Cl.

| | |
|---|---|
| ***A43B 3/12*** | (2006.01) |
| ***A43B 3/10*** | (2006.01) |
| ***A43B 5/08*** | (2006.01) |
| ***A43B 3/24*** | (2006.01) |

(52) U.S. Cl. ..... 36/11.5; 36/7.5; 36/8.1; 36/101

(58) Field of Classification Search ..... 36/100, 36/101, 99, 11.5, 7.5

See application file for complete search history.

(56) References Cited

U.S. PATENT DOCUMENTS

| | | | | |
|---|---|---|---|---|
| 1,844,997 | A | | 2/1932 | Weigle |
| 2,049,347 | A | * | 7/1936 | Benjamin ..... 36/58.5 |
| 3,631,613 | A | | 1/1972 | Brettell |
| 3,928,927 | A | | 12/1975 | Brown et al. |
| 3,978,596 | A | | 9/1976 | Brown et al. |
| 3,983,642 | A | * | 10/1976 | Liao ..... 36/101 |
| 4,172,330 | A | | 10/1979 | Kao |
| 4,372,060 | A | | 2/1983 | Adamik |
| 4,534,122 | A | | 8/1985 | MacPhail |
| 4,630,383 | A | | 12/1986 | Gamm |
| 4,733,439 | A | * | 3/1988 | Gentry ..... 206/338 |
| 4,805,321 | A | | 2/1989 | Tonkel |
| 4,864,736 | A | | 9/1989 | Bierk |
| 5,052,131 | A | | 10/1991 | Rondini |
| 5,094,016 | A | | 3/1992 | DiVito |
| 5,311,679 | A | | 5/1994 | Birch, Sr. |

(Continued)

*Primary Examiner*—Jila M Mohandesi
(74) *Attorney, Agent, or Firm*—Paul M. Denk

(57) ABSTRACT

The present invention pertains to footwear where the tongue, or strap, may be reversed, in order to change the aesthetics, coloration, indicia, or other appearance of the footwear. A sandal has an outer strap that reverses upon manipulation by the wearer, where the outer strap turns to expose one surface, which may have a stylized and attractive finish provided thereon, or it may be reversed, so as to change the coloration, indicia, design, or other appearance aspects of the sandal. Alternatively, the outer strap joins to a strap designed to contact the instep of a foot. Rotation of the outer strap occurs without removal of a foot from the strap or the sandal.

3 Claims, 2 Drawing Sheets

U.S. PATENT DOCUMENTS 5,379,529 A 1/1995 Smith et al.
5,410,822 A 5/1995 Vaccari
5,459,947 A 10/1995 Lasher
5,615,496 A 4/1997 Sharpstein
5,659,979 A 8/1997 Sileo
5,673,499 A 10/1997 Attilieni
5,896,684 A * 4/1999 Lin ..... 36/101
6,029,372 A 2/2000 Pan
6,094,841 A 8/2000 Adams
6,212,797 B1 4/2001 Merry et al.
6,237,250 B1 5/2001 Aguerre
6,321,466 B1 11/2001 Bordin et al.
6,397,497 B1 6/2002 McAtee
6,574,887 B2 6/2003 Jones et al.
6,848,199 B1 * 2/2005 Giannelli ..... 36/11.5
2002/0023372 A1 * 2/2002 Noda ..... 36/11.5
2002/0029494 A1 3/2002 Small
2003/0192205 A1 * 10/2003 Linens ..... 36/100

* cited by examiner

REVERSIBLE FOOTWEAR STRAP

CROSS REFERENCE TO RELATED APPLICATION

This continuation-in-part patent application claims priority as a continuation-in-part of the application having Ser. No. 10/771,196, which was filed on Feb. 3, 2004; now U.S. Pat. No. 6,904,706 is a continuation-in-part of the divisional patent application having Ser. No. 10/437,140, which was filed on May 13, 2003; now abandoned is a continuation-in-part of application having Ser. No. 10/222,313, filed on Aug. 15, 2002; now abandoned and, also is a continuation-in-part of the non-provisional patent application having Ser. No. 10/122,995 filed on Apr. 11, 2002, now U.S. Pat. No. 6,574,887, which application is derived from a provisional application having Ser. No. 60/285,693, filed Apr. 24, 2001; all owned by a common Assignee.

BACKGROUND OF THE INVENTION

This invention relates generally to footwear, and more specifically pertains to sandals, thongs, slip-ons and the like where the strap, may be reversed, in order to change the aesthetics, coloration, indicia, or other appearance of the overall footwear.

Numerous styles of footwear, constructed of various components and for achieving multiple purposes, have long existed in the prior art. Most of these innovations have been in the area of sandals which have enjoyed resurgence in recent years. Various styles or modifications to the sandals, as in their strap configurations, to make them more comfortable or suitable to rugged use have been considered in the prior art. Sandals as a class borrow various accessories from closed shoe footwear, such as tongue flaps.

Recent trends have even considered reversing various components of footwear, such as tongues, to alter the aesthetics of, to change the style of, and to improve the appearance of footwear when worn. For example, the Benjamin U.S. Pat. No. 2,049,347, shows a shoe wherein a strap, held by one or more of D-Rings, can be turned to reverse the positioning of the strap within the shoe structure. In addition, the patent to Tonkel, No. 4,805,321, shows the use of a separable tongue held by Velcro to its vamp, but which must be removed to provide for its turning and to vary the appearance of the shoe. However, sandals have retained the basic form of a strap secured to a sole.

The current invention modifies the strap of an open shoe, or sandal. The modifications add further variations in the use of the sandal, enhance its styling, and further enhance the attractiveness of the sandal, by providing alternative uses and applications to its components particularly the strap, when structured into the sandal itself.

SUMMARY OF THE INVENTION

This invention relates generally to footwear: sandal, thong, slip on and the like. The present invention specifically reverses the tongue or strap of footwear to change the aesthetics, coloration, indicia, or other appearance. The footwear has this invention embodied within its structure, as readily determined. In this invention, a select component of sandals will be reversible, structurally, as embodied within the manufactured sandal. In the preferred embodiment, a sandal will have an outer strap that reverses upon manipulation by the wearer, where the outer strap rotates to expose one surface, which may have a stylized and attractive surface provided thereon, or it may be reversed, to furnish an entirely different appearance to the sandal. The outer strap joins to a strap designed to contact the instep of a foot. Rotation of the outer strap occurs without removal of a foot from the strap or the sandal. An alternate embodiment has an outer strap alone that reverses.

The concept of this invention is a reversible outer strap upon the strap fixed to the sole and having a fixed length. The outer strap lets the wearer reverse it for revealing other coloration, indicia, or design as desired by the wearer. It provides versatility to the appearance of the sandal. The outer strap comprises similar material as the strap commonly leather, nylon, rubber, or other sturdy material.

It is, therefore, the principal object of this invention to provide a reversible outer strap, or the like, for sandals, slip-ons or other open footwear.

Another object of this invention is to provide a reversible component for a sandal, that may have different styles of appearance upon either of its surfaces, so that the outer strap, can be reversed, and completely change the appearance and attractiveness of the sandal. For example, the wearer can coordinate with team colors, fashion trends, and the like.

Still another object of this invention is to provide sandals that incorporate reversible components, which add to the versatility of the appearance and usage of the footwear.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
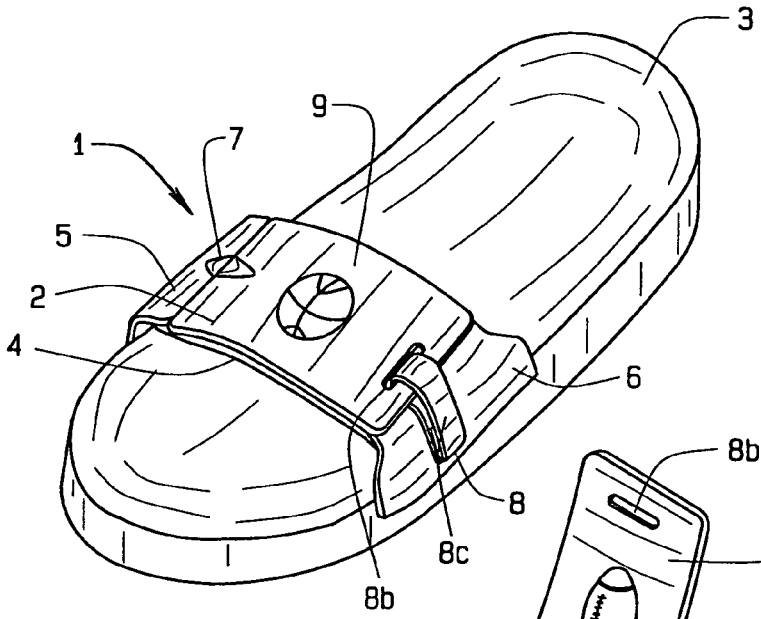
FIG. 1 is an isometric view of a sandal implementing a reversible outer strap according to the present invention.

In referring to the drawings, and in particular FIG. 1, the concept of the present invention 1 incorporates a reversible strap 4 or outer strap 2 into the structure of a sandal. The present invention begins with a sole 3 provided in a plurality of sizes for feet. The sole 3 has a generally foot shape with a rounded heel and toe. Proximate to the toe in the vicinity of the ball of the wearer's foot, the sandal secures to a foot with a strap 4.

The strap 4 spans the width of the sole 3 and attains a general arcuate form when worn over an instep. The strap 4 attaches to a first shoulder 5 on the inside of the sole 3 and an opposite second shoulder 6. The first shoulder 5 has a trapezoidal shape where the wide base adjoins the inner edge of the sole 3. The narrow base contains a generally centered swivel 7. The swivel 7 connects to an outer strap 2. The outer strap 2 has a generally rectangular shape with indicia, or printing, upon both faces. Opposite the swivel 7, the outer strap 2 has the second part 8*b* of a retaining means 8. In the preferred embodiment, the second part 8*b* is a generally centered rectangular slot through which passes the first part 8*a* of the retaining means 8.

The first part 8*a* of the retaining means 8 comprises a band 8*c* fixed upon one end 8*d* to the second shoulder 6 and an opposed free end 8*e*. The fixed end 8*d* and the free end 8*e* have complementary sections of hook and loop fasteners or like releasable devices such as bayonet clasps, snaps, or buttons. FIG. 1 shows the free end 8*e* of the retaining means 8 placed through the centered slot 8*b* upon the outer strap 2 and secured to the fixed end 8*d*. The first surface 9 of the outer strap 2 is displayed while the second surface 10 remains hidden.

Figure 2:
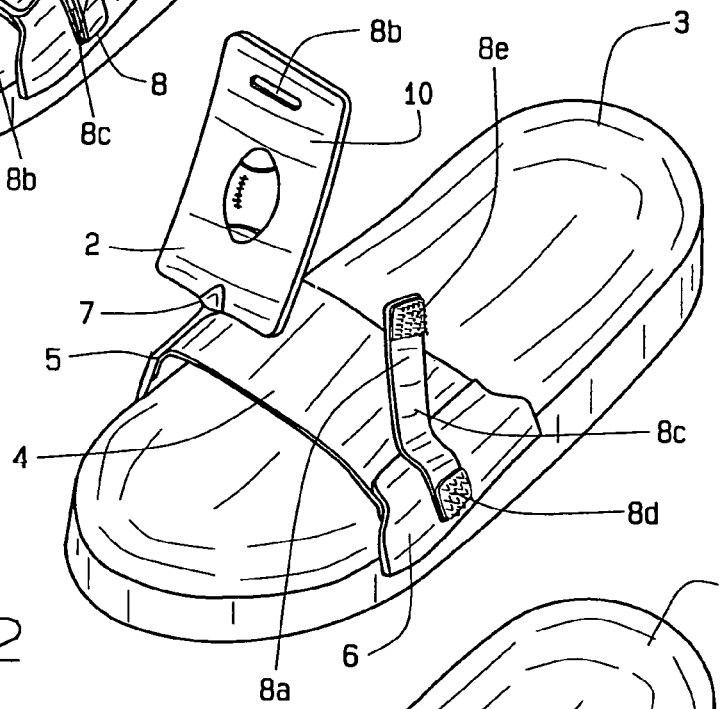
FIG.2 is another isometric view of a sandal opening the outer strap in accordance with the present invention.

FIG. 2 shows the present invention in use where the free end 8*e* of the retaining means 8 is released from the fixed end 8*d* and is removed from the centered slot 8*b*. Keeping a foot beneath the strap 4, a wearer rotates the outer strap 2 upon its longitudinal axis upon the swivel 7. Viewing the desired surface 9 or 10, the wearer returns the outer strap 2 to the strap 4 as shown in FIG. 3.

Figure 3:
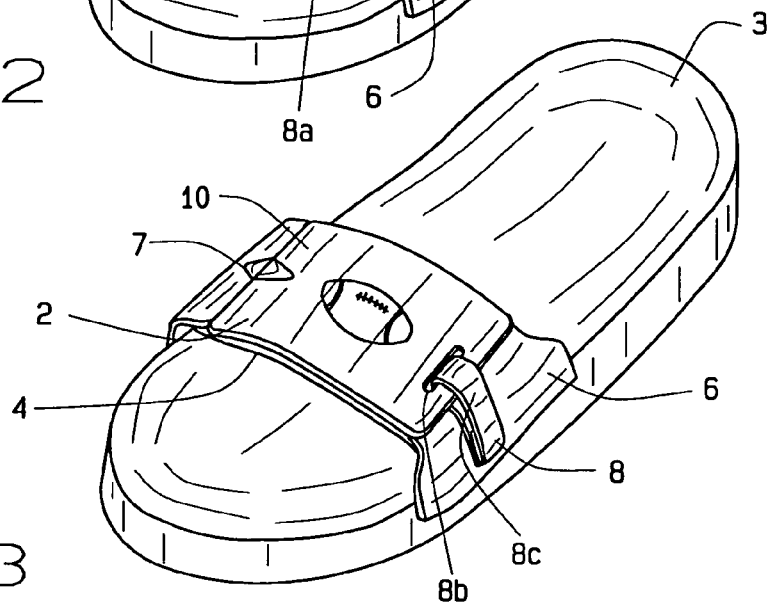
FIG. 3 is another isometric view of a sandal with the outer strap closed and showing the surface opposite that of FIG. 1.

Akin to FIG. 1, FIG. 3 displays the second surface 10 of the outer strap 2 as the first surface 9 is concealed. Following rotation of the outer strap 2 to the desired surface 10, a wearer secures the outer strap 2 to the strap 4. The wearer feeds the free end 8*e* of the retaining means 8 through the slot 8*b* of the outer strap 2 and secures the free end 8*e* to the fixed end 8*d*.

Figure 4:
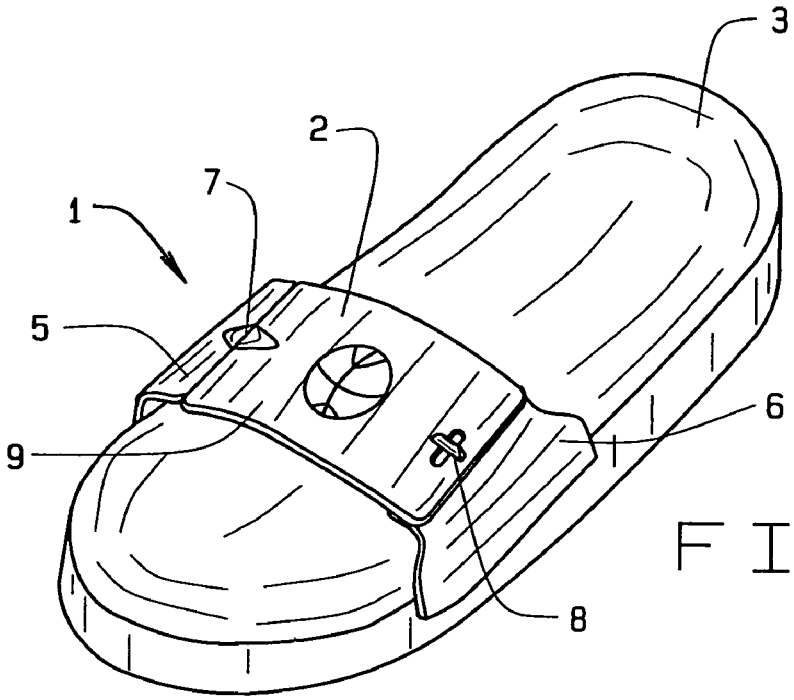
FIG. 4 is an isometric view of an alternate embodiment of a sandal implementing a reversible strap; and, FIG. 5 is another isometric view of an alternate embodiment with the reversible strap in an open configuration.

Turning to FIG. 4, an alternate embodiment of the present invention has a reversible strap 2 as the structure of a sandal. The alternate embodiment begins with a sole 3 provided in a plurality of sizes for feet and a general foot shape. Proximate to the toe in the vicinity of the ball of the wearer's foot, the sandal secures to a foot beneath an outer strap 2 alone.

The outer strap 2 spans the width of the sole 3 and bends when worn over an instep. The outer strap 2 attaches to a first shoulder 5 on the inside of the sole 3 and an opposite second shoulder 6. The first shoulder 5 has a trapezoidal shape where the wide base adjoins the inner edge of the sole 3. The narrow base contains a generally centered swivel 7. The swivel 7 connects to the outer strap 2 of a generally rectangular shape with indicia, or printing, upon both faces. Opposite the swivel 7, the outer strap 2 reaches the second shoulder 6. The second shoulder 6 has the first part 8*a* of a retaining means 8. In this alternate embodiment, the second part 8*b* is a generally centered slot through which passes the first part 8*a* of the retaining means 8.

The first part 8*a* of the retaining means 8 comprises a bayonet type lock of a rotating pin 8*f* that fits through the centered slot within the strap. Other retaining means may see use in the alternate embodiment such as hook and loop fasteners, snaps, buttons, clasps, or like releasable devices.

Figure 5:
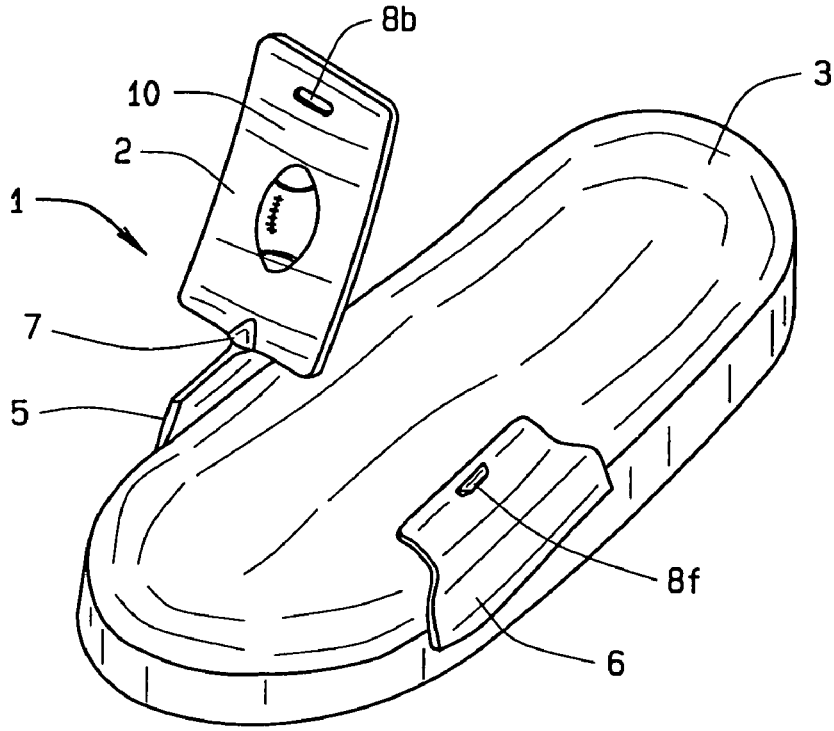

FIG. 5 shows the present invention in use where the bayonet lock rotates its pin 8*f* to align with the centered slot 8*b*. The slot 8*b* escapes the pin 8*b* and the outer strap 2 then releases from the retaining means 8 and begins to rotate. Keeping a foot upon the sole 3 of the sandal but exposing the instep, a wearer rotates the outer strap 2 upon its longitudinal axis while on the swivel 7. Viewing the desired surface 9 or 10, the wearer secures the outer strap 2 as done before in FIG. 4.

From the aforementioned description, a reversible footwear strap has been described. The reversible footwear strap is uniquely capable of changing the visible appearance of a sandal's strap between two surfaces. The reversible footwear strap and its various components may be manufactured from many materials including but not limited to polymers, high density polyethylene, polypropylene, polyethylene terephalate ethylene, leather, nylon, metallic foils, and composites.

Variations or modifications to the subject matter of this invention may occur to those skilled in the art upon reviewing the disclosure as provided herein. Such variations, if within the spirit of this development, are intended to be encompassed within the scope of any claims to the invention provided within this patent. The description of the preferred embodiment, as also depicted in the drawings, is set forth herein for illustrative purposes only.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. An item of footwear comprising:

a planar sole, having a general shape to fit a foot;

a means to connect the footwear to a foot, having an outer strap wherein said outer strap attaches to said connecting means by a linking means that allows rotation of said outer strap about the longitudinal axis of said outer strap thereby displaying alternate surfaces to change the appearance of the footwear;

a means to secure said outer strap to said connecting means;

said connecting means having a first shoulder upon the inside of said sole proximate to the ball of the foot, and a second shoulder upon the outside of said sole opposite to said first shoulder;

said linking means joining said first shoulder and said outer strap being generally centered both;

said linking means including a tapered swivel;

said securing means having a first part upon said second shoulder and a second part upon said outer strap opposite said linking mean; and said security means including hook and loop fasteners, buttons, snaps, or bayonet locks, and wherein said first part has a male securing means and said second part has a female securing means to receive said first part.

2. The footwear of claim 1 wherein said securing means is one of hook and loop fasteners and bayonet locks, and said second part upon said outer strap is a hole of complementary shape to receive said first part.

3. The footwear of claim 2 further comprising:

a strap, of similar shape to said outer strap, having a span between said first shoulder and said second shoulder and a location beneath said outer strap;

whereby, a foot remains beneath said strap while said outer strap rotates and the foot remains connected to the footwear when worn.

* * * * *